United States Patent [19]

Nunley et al.

[11] Patent Number: 4,601,151

[45] Date of Patent: Jul. 22, 1986

[54] WELDED ROOF SUPPORT

[75] Inventors: Charles L. Nunley, Dallas; Joe W. Tomaselli, Plano, both of Tex.

[73] Assignee: Loadmaster Systems, Inc., Dallas, Tex.

[21] Appl. No.: 647,041

[22] Filed: Sep. 4, 1984

[51] Int. Cl.[4] ..... E04B 7/04

[52] U.S. Cl. ..... 52/410; 219/127; 219/137 R; 228/165; 228/190

[58] Field of Search ..... 52/408, 410, 630, 167; 228/165, 189, 190; 219/137 R, 127

[56] References Cited

U.S. PATENT DOCUMENTS

| | | | |
|---|---|---|---|
| 1,939,732 | 12/1933 | Stresau | 228/165 X |
| 2,703,835 | 3/1955 | Douglas | 219/137 R |
| 4,232,612 | 11/1980 | Winsor | 228/165 X |
| 4,333,280 | 6/1982 | Morton | 52/167 |
| 4,441,295 | 4/1984 | Kelly | 52/410 |

*Primary Examiner*—Billy S. Taylor

*Attorney, Agent, or Firm*—Crutsinger, Booth & Ross

[57] ABSTRACT

A building roof, having an optimum strength to weight ratio, and method of constructing the roof wherein a horizontally disposed roof deck assembly particularly adapted to provide diaphragm shear strength and shear stiffness is formed comprising: a sheet (12) of steel corrugated material, a sheet (14) of optional insulation material, and a sheet (16) of rigid substrate material mechanically fastened together by screws (18). The sheet (12) of corrugated material is welded to purlins (20) by elongated welds (40) formed to resist rotation of the corrugated sheet (12) in a horizontal plane. The screws (18) extend through the rigid substrate (16) and through rigids (11) on the upper side of the corrugated sheet (12) to form a truss-like structure extending generally parallel to the purlins (20). Weld washers 30 having elongated slots (35) are used to secure high tensile strength symmetrically corrugated steel (12) having a thickness in a range of 0.0144 inch to 0.0359 inch to purlins (20) to provide diaphragm shear stiffness and shear strength.

3 Claims, 7 Drawing Figures

WELDED ROOF SUPPORT

CROSS REFERENCE TO RELATED APPLICATIONS

This application relates to improvements in roof decks of the type disclosed in copending application Ser. No. 330,335, filed Dec. 14, 1981, and now abandoned, the disclosure of which is incorporated herein by reference.

TECHNICAL FIELD

Frequently, the roof deck assembly must function as a structural diaphragm to reinforce a building against lateral loads created by seismic shocks, wind or explosive forces. In such applications, the horizontal roof deck assembly is constructed to be the plate of a web of a girder oriented in a horizontal plane with the walls of the building serving as the compression and tension chords of the girder.

The diaphragm (plate web) strength of a given roof deck assembly is evaluated in terms of its ability to transfer diagonal tension stresses, which involves consideration of the shear resistance of the assembly, and in-plane deflection (referred to as "diaphragm deflection"), which is governed to a large extent by the "diaphragm stiffness" of the steel panel sections that are utilized. Diaphragm stiffness is related to the ability of the steel panel sections to resist distortion under axial load.

It is generally known that an "ideal" diaphragm would consist of a thin plane sheet or membrane attached to a structure in such a way (at the support level) that it can resist shear forces through diagonal tension field action. Heretofore it has not been possible, however, for a steel roof deck assembly to function as an "ideal" diaphragm because to satisfy their purpose, roof deck assemblies are also required to support vertically imposed loads which requires rib construction. Accordingly, the diaphragm stiffness that a given steel panel section can provide depends on the proximity of the steel in the section to the stress plane, which is located at the immediate top of the supporting purlins. In this respect, flat profile steel panel configurations wherein most of the steel is elevated above the support level (the stress plane) have less diaphragm stiffness than sections that provide more steel nearer to the stress plane such as a symmetrical rib pattern.

Roof decks, in order to comply with state and local regulations, must meet established performance standards. In general, these performance standards are divided into two broad areas: (1) Sloped roof decks, generally 30 degrees or greater from horizontal and (2) Flat roof decks, 0 degrees to 30 degrees slope from horizontal.

The performance standards for flat roof deck construction vary slightly from area to area but generally conform to the following:

1. Vertical Load Strength: A roof deck must be able to carry a total load consisting of dead load plus live load and not exceed legislated design or performance values for the materials being utilized in the roof deck assembly.

Example: Conventional steel roof decks manufactured from 50,000 to 60,000 psi steel must not be stressed under working conditions beyond a flexural tensile stress of 20,000 psi.

2. Live Load Deflections: While supporting the designed dead load (weight of steel deck, built-up roof and insulation) the roof deck must not deflect under live load application more than 1/240th of the distance between the support members.

Example: A roof deck supported by members 6'0" on center must not deflect more than 6'0"×12 in./ft.×1/240 equal 0.30" under live load application. Live loads will vary in different climate areas from 20 pounds per sq. ft. to 60 lbs./sq. ft., depending upon weather conditions.

3. Wind Up-Lift Resistance: While not at this time in complete use by all code bodies, this performance requirement is being adopted fairly rapidly and currently is in use in many areas. Under wind loadings from storms, hurricanes, etc., the roof deck must resist negative and positive pressures applied to it and remain structurally serviceable. Performance values for this standard vary depending upon geographical areas, but in general, range from 30 psf uplift resistance (equivalent of 100 mph winds) to 90 psf uplift resistance (equivalent of 188 mph winds.).

Heretofore steel roof deck assemblies have utilized sections formed from mild steel in patterns normally referred to as "Type A", "Type "B", "Type AB", and "Type F." The mild steel was attached to supporting purlins by a series of $\frac{5}{8}$" diameter arc spot welds, sometimes referred to as puddle welds. Weld washers were not required because of the thickness of the mild steel deck. The common feature of the sections is a wide flat surface element, formed between stiffening ribs that provide the stiffness and strength to the section. The steel sections, supported by purlins, have been designed heretofore to meet strength requirements specified by building codes. The flat surfaces have been employed to provide a supporting surface for one or more layers of sheet material comprising a single board serving to insulate and provide a surface to which waterproof covering was attached.

A typical "Type A" section, for example, provides a flat portion of approximately $5\frac{1}{2}$ inches wide between $1\frac{1}{2}$ inch deep ribs that are spaced six inches apart. The "Type B, AB" and other, sections are similar in profile to a Type A section except that the flat portions between stiffening ribs is progressively reduced in width to create a closer spacing of the stiffening ribs, increasing the load capacity for a given span. However, the width of rib openings on the top surface of the sheet, for example of a Type B section is greater than that of a Type A section.

The most efficient light gauge steel sections from a strength standpoint are those that have the greatest number of stiffening ribs per unit of width; the ultimate being the symmetrical rib pattern sections which have an equal distribution of steel above and below a neutral axis lying in a plane passing through the center of the sheet and disposed parallel with upper and lower surfaces of the sheet.

The symmetrically corrugated sheet section is not new to the construction industry and has been utilized for many years as siding and roofing. However, prior to the development of the roof deck construction disclosed in U.S. application Ser. No. 330,335 the symmetrically corrugated configuration had not been used in flat roof dry installed roof deck construction because it does not comply with the required performance standards when installed in the conventional manner. While theoretically being able to support design loads, in practical use the section bends and distorts under loading, therefore destroying its load carrying capabilities. The sections when installed in conventional manner exhibit poor flexural capabilities in deflection and therefore cannot satisfy the deflection requirements specified by building codes because these steel sections do not satisfy the minimum steel thickness to element-width ratios that govern the design of light gauge steel sections.

Since the flexural strength of a steel panel section is, to a large degree, a function of the depth of the section, it is naturally opposed to the reduction of depth (approaching a thin plane of steel) that contributes to diaphragm strength. The most efficient roof deck assemblies, from the standpoint of diaphragm strength, are those that can provide adequate flexural strength, utilizing steel sections with the maximum degree of effective steel in the diaphragm stress plane. Diaphragm stiffness increases proportionally to increases in the yield strength of the steel that is utilized, hence, steel sections made of high tensile steel are more effective than those made of mild steel.

Heavy gauge, mild steel (for example, 22 gauge, 20 gauge and 18 gauge with a design stress limit of 20,000 pounds per square inch) is generally employed in the manufacture of Type A and similar flat profile sections. This has been due to the fact that heavier gauges are necessary to satisfy the minimum steel thickness to element-width ratios that govern the design of light gauge steel sections. Because of the steel thickness of these sections, $\frac{5}{8}''$ diameter puddle welds have been used to attach the steel deck to the purlins. On the other hand, the symmetrical rib pattern sections have smaller unit-width elements and hence can utilize the more effective high tensile strength steel in lighter gauges providing greater working strength per pound of steel.

Roof decks built in accordance with teachings of the aforesaid U.S. application Ser. No. 330,335 have achieved considerable commercial acceptance and several million square feet of such roof construction have been installed in recent years.

Weld washers having circular central openings have been employed for welding the corrugated sheet material to purlins or beams extending horizontally below the corrugated material.

It has been discovered that although the roof deck construction was designed primarily to carry vertical loading and resist wind uplift forces, welds securing the corrugated material to purlins were subjected to substantial lateral shear force resulting from axial loading produced by wind force which is carried by and transmitted through the light weight steel deck and welds to the supporting purlins. This shear force resulted from movement of one wall of a rectangular building relative to another applying horizontal loading to a rectangular roof structure tending to distort the rectangular structure to a parallegram-like structure.

SUMMARY OF INVENTION

A roof deck constructed in accordance with the teachings of U.S. patent application Ser. No. 330,335 is secured to supporting purlins by an improved weld construction comprising a rectangular shaped weld washer having an elongated slot formed therein. A symmetrically corrugated material is positioned such that ridges and valleys on the symmetrically corrugated material extend transversely between spaced purlins. The weld washer is positioned such that the elongated slot extends in a direction parallel to valleys in the symmetrically corrugated material and transversely of the purlins.

An electric arc welding apparatus and electrode are employed for melting the portion of the weld washer adjacent to the periphery of the slot, the corrugated material and the upper surface of the supporting purlin such that the three elements are integrally bonded together and the thin corrugated material is restrained adjacent the weld to resist lateral deformation.

The roof deck functions as a structural diaphragm and the elongated welds securing the corrugated material to the purlins resist rotation and distortion of the valley of the horizontal corrugated material in a horizontal plane. The rigid sheet material, such as a board constructed of gypsum, secured by screws to ridges oriented above the neutral axis of the corrugated material, intermediate to the purlins forms a truss-like construction intermediate opposite ends of the span between the purlins.

The diaphragm stiffness resulting from the shear strength of the improved welds and the shear stiffness of the corrugated high tensile strength steel reinforced by the gypsum board secured to the upper surface thereof by screws permits the installation of a roof deck having significantly improved strength characteristics while utilizing lighter weight and less expensive materials than that employed in roofs heretofore devised.

DESCRIPTION OF DRAWINGS

Drawings of a preferred embodiment of the invention are annexed hereto, so that the invention may be better and more fully understood, in which.

Numeral references are employed to designate like parts throughout the various figures of the drawings.

DESCRIPTION OF A PREFERRED EMBODIMENT

Figure 1:
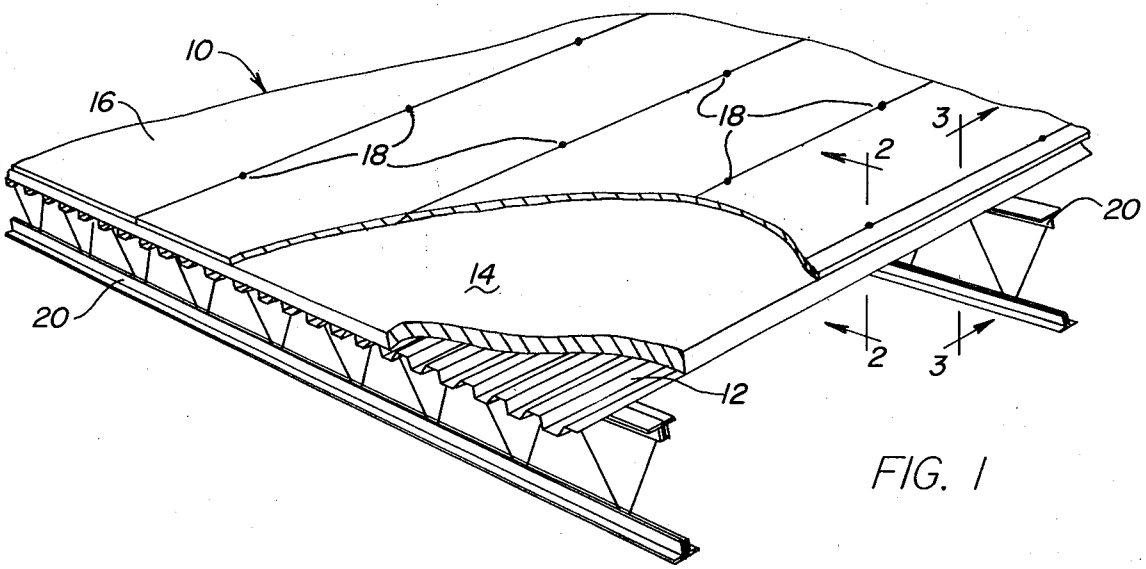
FIG. 1 is a fragmentary perspective view of a roof deck secured by elongated welds to supporting purlins.

Referring to FIG. 1 of the drawings, the numeral 10 generally designates a roof deck comprising a sheet 12 of corrugated material, an optional sheet 14 of foamed insulation material and a sheet 16 of rigid gypsum board, the sheet of gypsum board 16 being secured by screws 18 to ridges 11 of the corrugated sheet, as will be hereinafter more fully explained. Valleys 13 of the corrugated sheet are welded to and span across space between purlins 20. The improved welding washer and method of attaching the sheet 12 of corrugated material to purlins 20 is more clearly illustrated in FIGS. 2-6 of the drawing.

Figure 2:
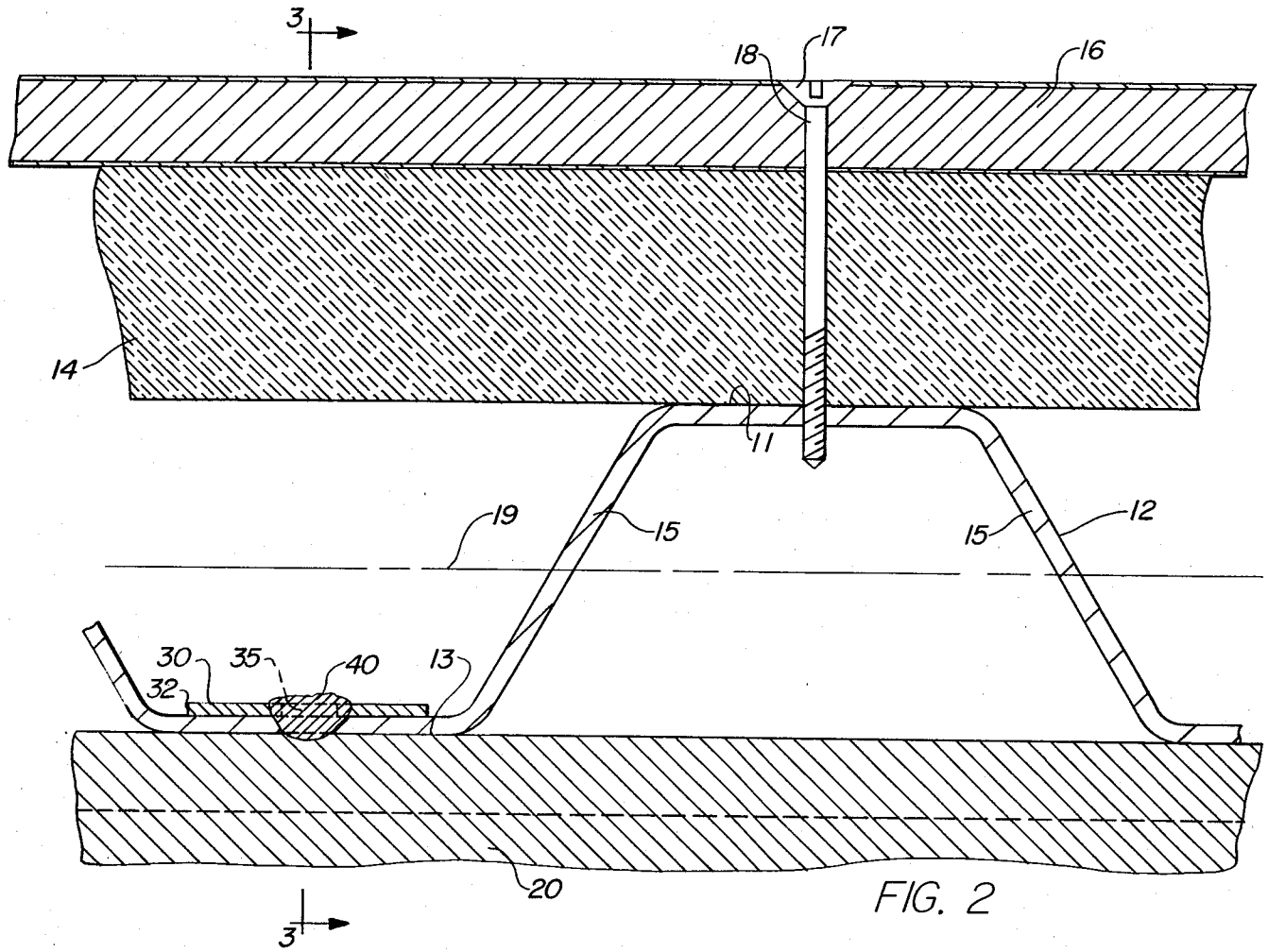
FIG. 2 is an enlarged cross sectional view taken along line 2—2 of FIG. 1.

Corrugated sheet 12 preferably has flat ridge portions 11 and flat valley portions 13 of substantially equal length joined by connector portions 15 providing straight, parallel, regular and equally curved ridges and hollows. As best illustrated in FIG. 2, this configuration has a substantially equal distribution of surface area of the corrugated sheet above and below a neutral axis 19.

The sheet 14 of insulation material preferably comprises a closed cell foamed material such as polystyrene or polyisocyanurate formulated to provide a high degree of thermal insulating quality at ambient atmospheric temperatures. This component is optional and is used when a high degree of thermal insulation is desired.

Sheet 16 of gypsum board preferably comprises a flat smooth sheet of incombustible, water resistant, fiberglass reinforced material having an impervious paper cover to permit migration of moisture from the gypsum board when hot asphalt is applied thereto.

Screws 18 extend through sheets 14 and 16 and are anchored in upper ridges 11 of corrugated sheet 12. It will be appreciated that screws 18 secure sheets 14 and 16 relative to upper ridges 11 of the corrugated sheet but do not extend into purlins 20. Thus, screws 18 contribute to the shear strength and shear stiffness of roof deck 10, but are not employed for securing the roof deck to the purlins.

It should be noted that screws 18 have enlarged heads 17 which engage the rigid sheet 16. As hereinbefore noted, sheet 14 of insulation material has very low density and consequently has insufficient internal strength to hold screw heads 17 without pulling through the material.

The roof deck assembly 10 provides a flat surface having sufficient strength to support a waterproof roofing membrane and permits use of a symmetrical rib pattern in the corrugated sheet 12 which provides both flexural and diaphragm shear strength and shear stiffness when the upper ridges 11 are restrained against movement in a horizontal direction by the flat sheet 16 and screws 18.

Ridges 11 are in compression when a downwardly directed force is applied to the upper surface on the roof deck. Ridges 11 on the thin corrugated sheet 12 are somewhat analogous to a slender column when in compression. Screws 18 are positioned such that the unsupported length of the thin ridges is significantly less than the distance between spaced purlins 20 to increase the load carrying capability of corrugated sheet 12. The horizontally disposed sheet 16, screws 18, and connector portions 15 of the symmetrically corrugated sheet 12 of high tensile strength steel interact to form a truss-like structure extending generally parallel to the purlins intermediate ends of the span. This truss-like structure greatly increases the shear strength of the corrugated sheet 12.

Figure 4:
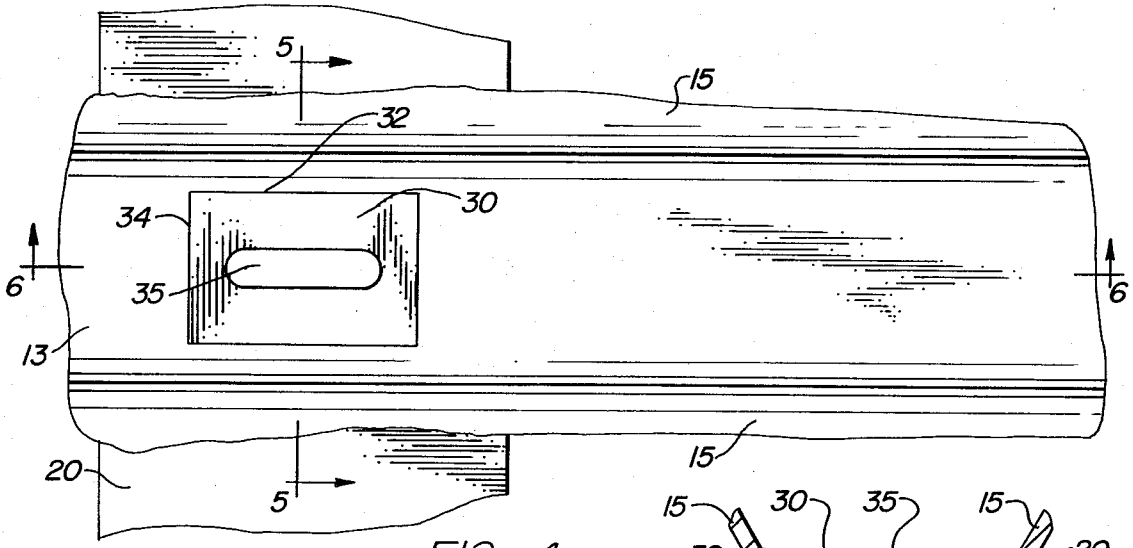
FIG. 4 is a cross sectional view taken along line 4—4 of FIG. 3.

As best illustrated in FIG. 4 of the drawing, rectangular shaped, weld washers 30 have a long side 32 measuring $1\frac{1}{2}$ inches, a short side 34 measuring $\frac{3}{4}$ of an inch and a minimum thickness of 0.061 inch. A slot 35 is formed in weld washer 30, the slot having a nominal width of $\frac{1}{4}$ inch and a nominal overall length of 1 inch. Slot 35 is formed by two semi-circular openings having a radius of $\frac{1}{8}$ inch and straight side surfaces which are tangent to the spaced semi-circular portions. Centers of the circular end portions of slot 35 are thus spaced $\frac{3}{4}$ of 1 inch apart. As will be hereinafter more fully explained, the slot 35 preferably has a length which is approximately four times the width. This configuration facilitates forming a weld having a periphery which is significantly longer than the circumference of a circle for a weld having a specified cross sectional area.

Figure 3:
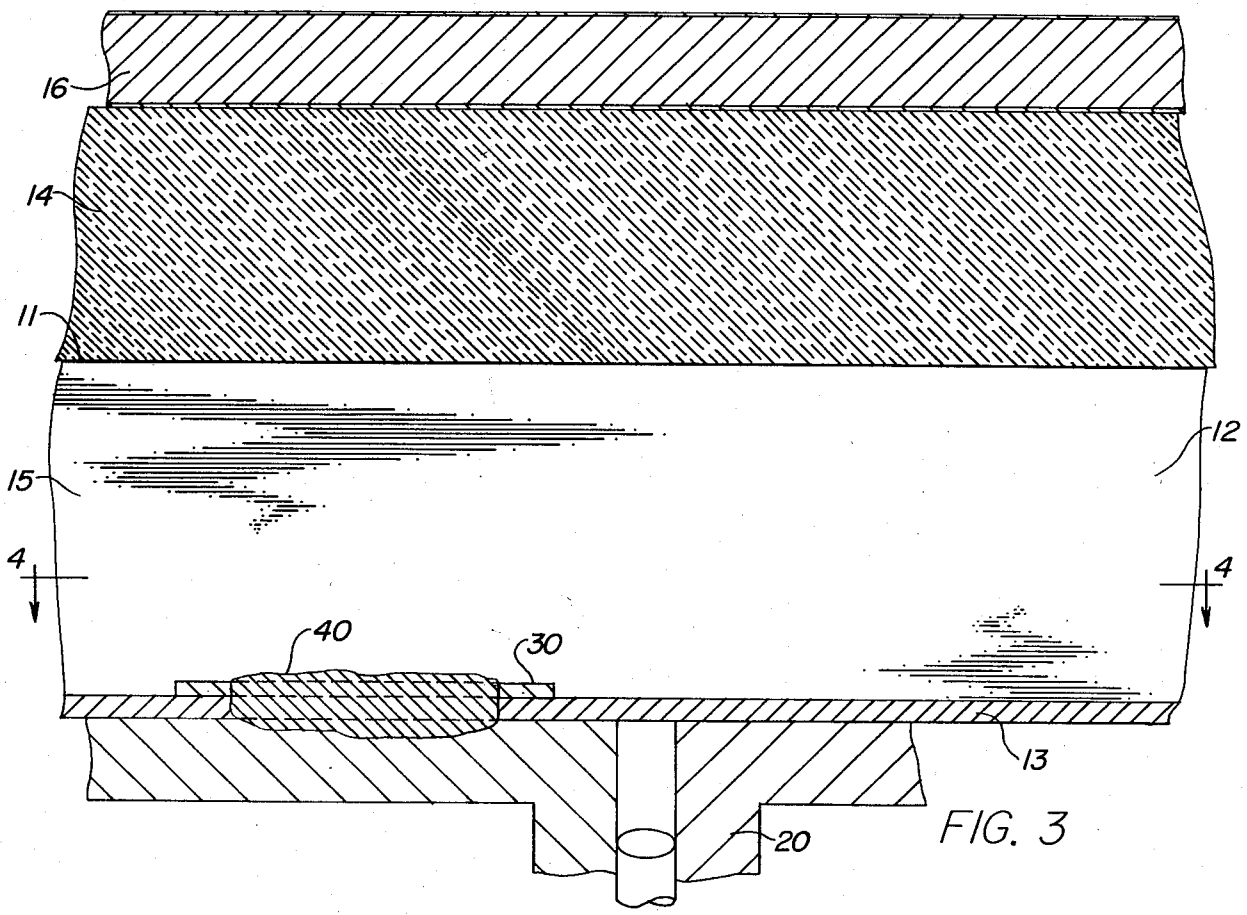
FIG. 3 is an enlarged cross sectional view taken along line 3—3 of FIG. 1.

As illustrated in FIGS. 3 and 4 of the drawing, the long side 32 of weld washer 30 extends transversely of purlin 20 and in a direction parallel to valley 13 on the sheet 12 of corrugated material.

Figure 6:
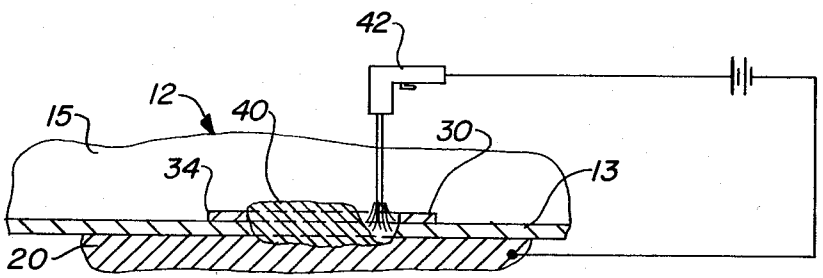
FIG. 6 is a cross sectional view taken along line 6—6 of FIG. 4.
Figure 7:
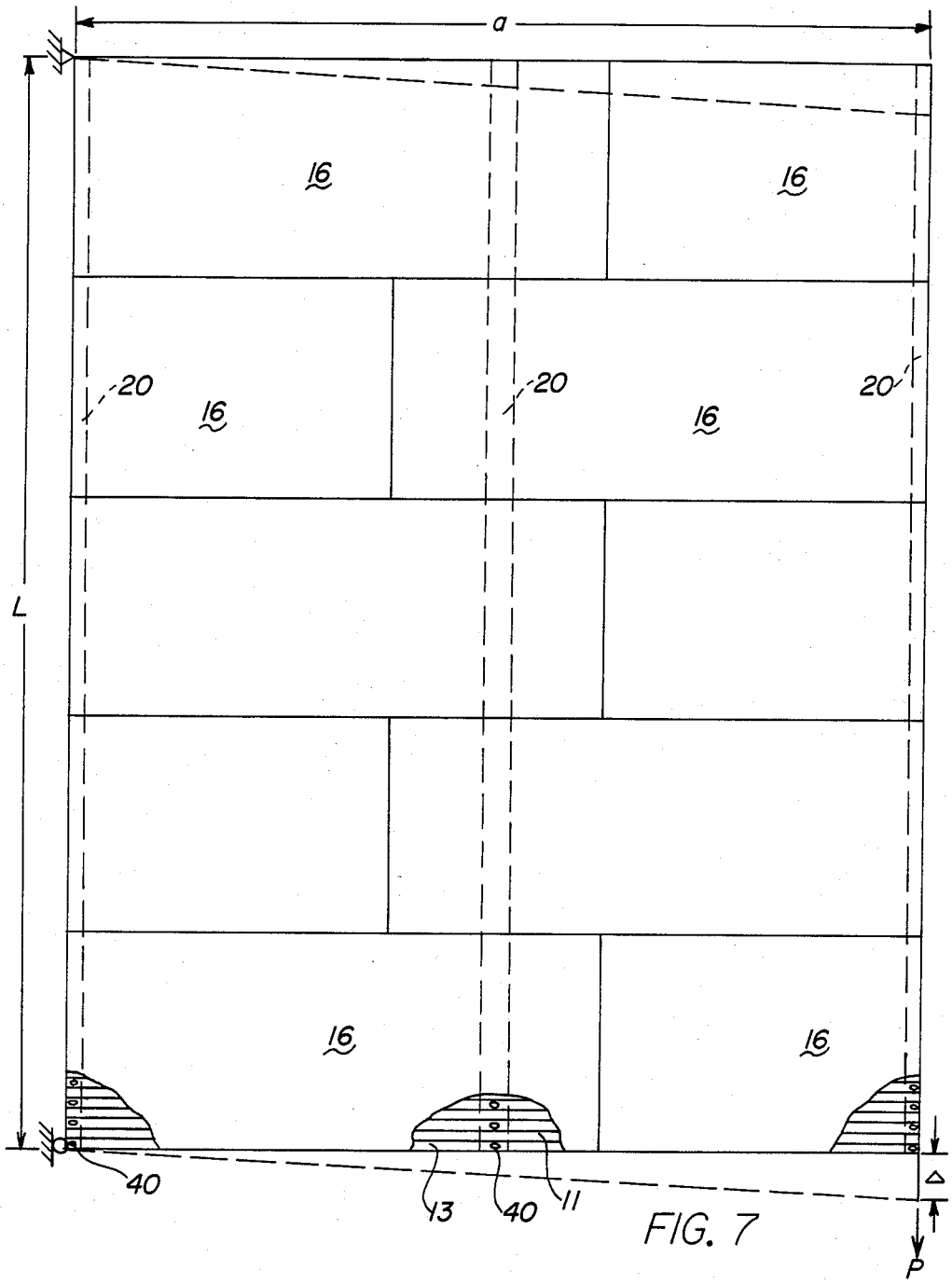
FIG. 7 is a diagrammatic view illustrating a test fixture employed for determining the shear stiffness of a roof diaphragm.

As diagrammatically illustrated in FIG. 6 of the drawing, an electric arc weld process is employed for bonding welding washer 30, valley 13 and the upper surface of purlin 20 together to form a strong rigid integral construction.

The arc welding machine 42 may be of conventional design and generally includes an engine driven generator and a welding gun with a pistol grip supporting a coated electrode. The specification for mild steel covered arc-welding electrodes (AWS A5.1-69) provides twelve classifications for electrodes. A suitable electrode designated E6013 is preferred for this particular application. Such electrodes are designed for use in a direct current arc welding process. An electrode having a diameter of 5 thirty-seconds of an inch and a welder setting of 190 amperes of direct current and straight polarity provides good results. Extensive tests have been conducted to obtain the dimensions and characteristics of a weld washer that provides optimum strength in relation to the weld time for supporting a specified corrugated sheet of material.

The AWS D1.3-81 and the AISI Specification for Cold-Formed Steel Design (4.2.1.2.2) are recognized standards for attaching thin steel sheets to thicker support members with arc spot welds. In these specifications, the allowable shear loads per weld are limited by shear across the fused diameter $d_e$ or by sheet strength around an average diameter $d_a$. It can be noted that, when the ratio of diameter $d_a$ to base metal thickness of the sheet 5 ($d_a/t$) changes, the allowable load P changes. The thinner sheets without a weld washer have more tendency to buckle and warp in the weld vicinity than do thicker sheets and the welds are, therefore, weaker.

Neither of the above cited specifications is clear as to the expected results of welds made through weld washers since the effective diameter, $d_a$, of the arc spot weld or puddle weld is not defined. It is clear that the use of weld washers permits higher welding temperatures without the attendant "burn-out" of sheets around the weld. Consequently, the effective diameter $d_a$ may be larger than the washer opening $d_o$ because the washer itself is an adequate heat sink to prohibit sheet burn-out while raising the sheet and support members to adequate fusion temperatures. Tests were conducted to study welds made through round holes in weld washers, washers of different thickness and hole diameter, and connecting different sheet thicknesses to structural members. Additional tests were conducted using rectangular shaped weld washers of different thicknesses having slotted openings for welding steel sheets of various thicknesses to structural members. The control of the weld was through an established burnoff rate of the welding rod or electrode and established welding time. The welding operation on any one weld was terminated when the weld washer opening was judged to be full of weld material.

The published AWS/AISI design information indicates that for an arc spot weld using a welding washer having a round hole formed therein $Q_f=2.5(0.88tF_ud_a)$ where:

t=base metal thickness in inches d=0.50 inches (visible diameter of the outer surface of the weld)

$d_a = d - t$

Fu = ultimate strength of the base metal

Several tests were conducted and data recorded for the strength of welds formed through round openings in weld washers. Tests were conducted using washers of various thicknesses and having openings of various diameters.

A careful study of recorded data and consideration of all variables involved indicated that the sheet stability around welds is not a problem because the washer forces the steel sheet to remain flat near the weld. The effective diameter of an arc spot weld formed through a round opening in a welding washer was found to be:

$$Kd_o = (0.9 + 100[t/d_o]^2)$$

where:

t = base metal thickness in inches $d_o$ = weld washer opening diameter in inches Tests conducted for attaching a twenty-five gauge panel of symmetrically corrugated high tensile strength steel having a thickness of 0.0194 inches and an ultimate strength of 110.2 Ksi (1,000 pounds per square inch) using a weld washer having a thickness of 0.061 inches and a round opening having a diameter of ⅜ of one inch resulted in the formation of a weld having a strength $Q_f$ of 1.48 kip. A second test using the same materials resulted in $Q_f = 1.20$ kip and a third test resulted in $Q_f = 1.70$ kip. Thus, the observed weld strength and the theoretical strength calculated using the equation for a spot weld through a round opening in a weld washer were in agreement within a range of plus or minus 10 percent. The slight scatter range was narrow indicating good agreement between tested and predicted results.

For an arc seam weld without a weld washer, the AWS/AISI design information indicates that a common equation is $Q_f = 2.5(tF_u)(0.25\ L + 0.96d_a)$ where:

$Q_f$ = weld strength t = base metal thickness in inches $F_u$ = ultimate strength of the base metal L = length of the weld in inches d = width of the weld in inches When an arc seam weld without a weld washer is loaded parallel to the long direction of the seam, the response is complex. Over the length L, strength is limited by the steel sheet shear capacity while, at one end the weld is in bearing or compression and the other in tension. The weakest zone in this three faceted problem most probably is shear.

Figure 5:
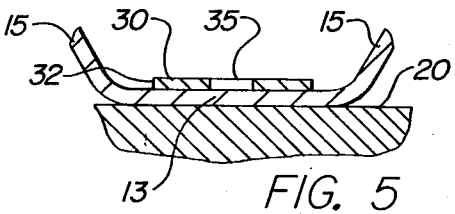
FIG. 5 is a cross sectional view taken along line 5—5 of FIG. 4.

Using the same twenty-five gauge symmetrically corrugated high tensile steel sheet described above and a welding washer having a thickness of 0.061 inches and an opening formed as illustrated in FIGS. 4 and 5 of the drawing and as hereinbefore described produced welds in three different tests having strengths $Q_f = 2.30$ kip; $Q_f = 2.18$ kip; and $Q_f = 2.20$ kip.

Comparing the strength of welds using welding washers having round openings to the strength of welds formed through weld washers having non-circular openings it will be observed that the non-circular opening provided greatly increased strength.

The increased strength results from the increase in the perimeter of the opening or the distance around the periphery of the weld such that force is distributed over a larger area thereby reducing the maximum stress in the base material while the body of the washer around the non-circular opening forces the base material to remain flat near the weld.

Welds of various length and width were studied to determine the change in strength of the weld versus the weight or cost of materials and time required for forming the welds.

A study of welding efficiency indicated that a limit was reached at which a larger sized weld required an increase in welding time which was beyond the associated increase in strength. For example, changing the length and width of one weld resulted in a 17 percent increase in the strength but required a 42 percent increase in welding time.

As a result of the studies and data observed, we have determined that the welding washer hereinbefore described provides optimum strength to weight ratio for providing a welded support for a roof deck of the type disclosed and claimed in U.S. application Ser. No. 330,335.

The symmetrically corrugated sheet of high tensile strength steel tested ranged from 28 gauge having a thickness of 0.0144 inches, to 20 gauge having a thickness of 0.0359 inches. The 28 gauge material was welded to purlins having a minimum span of four feet while the 20 gauge material was welded to purlins to form spans of up to 12 feet. In each instance welding washers 30 had non-circular openings and had a minimum thickness of 0.061 inches. Openings 35 in the weld washers were slotted openings having a length which was at least four times the width of the slotted opening.

Non-circular welds 40 fuse the non-circular weld washers, the valley 13 of the symmetrically corrugated steel sheet 12 and the purlins 22 to integrally connect the sheet 12 to the purlins 20. A flat sheet 16 of substrate material was secured by screws 18 to ridges 11 to form a series of essentially triangular shaped trusses throughout the span between the purlins. As illustrated in FIG. 2, it will be observed that connector portions 15 on corrugated sheet 12 are restrained against lateral movement by flat sheet 16 and screw 18. The valley 13 on the corrugated sheet is restrained against rotation in a horizontal plane by non-circular welds 40 having a long dimension extending in the direction of the length of the valley 13 on the corrugated sheet. Thus, this truss-like structure throughout the span intermediate purlins 20 tends to stabilize and prevent deformation of the corrugated sheet.

It should be readily apparent that the specific shape of opening 35 in weld washer 30 may vary and that the weld need not be a straight weld as that illustrated in the drawing. However, it is important that the weld be non-circular since a circular weld would result in a periphery or circumference of minimum length for a weld having a specified cross section. We have observed that by increasing the length of the periphery of the weld through a welding washer to prevent deformation of the base material adjacent the periphery of the weld results in a substantial increase in the shear strength of the weld.

Having described our invention, we claim:

1. In a roof deck functioning as a structural diaphragm to provide rigidity to a building: spaced purlins; corrugated sheet material supported from below and spanning the distance between said purlins; weld washers having an elongated non-circular slot extending perpendicular to the direction of the purlin on the upper surface of valleys of the corrugated sheets; and spaced welds formed in the elongated slots in the weld washers, said weld extending through and bonding the weld washer, the valley of the corrugated sheet and the purlin, said welds having a length extending transversely of the purlin and resisting rotation of the valley on the corrugated sheet in a horizontal plane.

2. A roof deck according to claim 1 with the addition of a sheet of flat rigid material secured to ridges of the corrugated material; and screws extending through the flat rigid material and anchored in the upper ridges of the corrugated material to form a truss extending transversely of the ridges, said truss being generally parallel to and spaced between said purlins.

3. A roof deck having an optimum strength to weight ratio comprising: a symmetrically corrugated sheet of high tensile strength steel having a thickness in a range of 0.0144 to 0.0359 inches, said corrugated sheet having upwardly extending ridges and downwardly extending valleys of equal width; horizontally disposed purlins spaced to form spans in a range of four feet to twelve feet; non-circular weld washers having a minimum thickness of 0.061 inch, said weld washers having non-circular openings having a length which is at least four times the width of the non-circular openings; non-circular welds fusing the non-circular weld washers, the valley of the symmetrically corrugated steel sheet and the purlins to integrally connect the steel sheet to the purlins; a flat sheet of substrate material; and screws securing the sheet of substrate material to ridges on the corrugated sheet to form a series of essentially triangular shaped trusses throughout the span between the purlins to stabilize and prevent deformation of the corrugated sheet, the non-circular welds preventing rotation of valleys on the corrugated sheet relative to the purlins.

* * * * *